US008483893B2

(12) United States Patent
Karg

(10) Patent No.: US 8,483,893 B2
(45) Date of Patent: Jul. 9, 2013

(54) SYSTEM AND METHOD OF DETERMINING TRAIN LENGTH

(75) Inventor: Kenneth Andrew Karg, Belle Vernon, PA (US)

(73) Assignee: Bombardier Transportation GmbH, Berlin (DE)

( * ) Notice: Subject to any disclaimer, the term of this patent is extended or adjusted under 35 U.S.C. 154(b) by 138 days.

(21) Appl. No.: 12/823,850

(22) Filed: Jun. 25, 2010

(65) Prior Publication Data

US 2011/0320071 A1 Dec. 29, 2011

(51) Int. Cl.
*G06F 7/00* (2006.01)
*G06F 17/00* (2006.01)

(52) U.S. Cl.
USPC ..... 701/19; 340/988

(58) Field of Classification Search
USPC ..... 701/19; 340/988–996
See application file for complete search history.

(56) References Cited

U.S. PATENT DOCUMENTS

| | | | | |
|---|---|---|---|---|
| 3,573,441 | A | 4/1971 | Glazar | |
| 3,581,071 | A | 5/1971 | Payseure | |
| 5,777,547 | A * | 7/1998 | Waldrop | 340/438 |
| 5,815,823 | A * | 9/1998 | Engle | 701/19 |
| 6,023,966 | A * | 2/2000 | Mazur et al. | 73/129 |
| 7,618,011 | B2 * | 11/2009 | Oleski et al. | 246/167 R |

FOREIGN PATENT DOCUMENTS

EP 0650429 B1 8/1999

* cited by examiner

*Primary Examiner* — Thomas Tarcza
*Assistant Examiner* — Tyler J Lee
(74) *Attorney, Agent, or Firm* — The Webb Law Firm

(57) ABSTRACT

A system for determining number of cars within a train consist includes one or more cars, at least one automatic train controller (ATC) for the one or more cars, and a train line spanning the consist. Each car comprises a frequency generator and a frequency modifier. Each frequency modifier in each of the one or more cars is adapted to receive an input signal at an input frequency and generate an output signal at an output frequency different from the input frequency. A frequency generator in at least one of the cars provides a predetermined input signal at a predetermined input frequency to the frequency modifier in the at least one car when the at least one car is designated as a lead car and at least one frequency modifier in at least one of the one or more cars provides its output signal to the train line.

12 Claims, 8 Drawing Sheets

FIG. 7

| Input Frequency (Hz) | 4096 | 2048 | 1024 | 512 | 256 |
|---|---|---|---|---|---|
| Car Number | 20-1 | 20-2 | 20-3 | 20-4 | 20-5 |
| Output Frequency (Hz) | 2048 | 1024 | 512 | 256 | 128 |

FIG. 8

| Input Frequency (Hz) | 128 | 256 | 512 | 1024 | 2048 |
|---|---|---|---|---|---|
| Car Number | 20-1 | 20-2 | 20-3 | 20-4 | 20-5 |
| Output Frequency (Hz) | 256 | 512 | 1024 | 2048 | 4096 |

FIG. 9

| Frequency (Hz) | 4096 | 2048 | 1024 | 512 | 256 | 128 | 64 | 32 | 16 | 8 | 4 |
|---|---|---|---|---|---|---|---|---|---|---|---|
| Number of Cars in the train consist | 1 | 2 | 3 | 4 | 5 | 6 | 7 | 8 | 9 | 10 | 11 |

FIG. 10

| Frequency (Hz) | 8192 | 4096 | 2048 | 1024 | 512 | 256 | 128 | 64 | 32 | 16 | 8 | 4 |
|---|---|---|---|---|---|---|---|---|---|---|---|---|
| Position in the train consist | 1 | 2 | 3 | 4 | 5 | 6 | 7 | 8 | 9 | 10 | 11 | 12 |

SYSTEM AND METHOD OF DETERMINING TRAIN LENGTH

BACKGROUND OF THE INVENTION

1. Field of the Invention

The present invention relates to train control and, more particularly, to determining the number of cars of a train consist.

2. Description of the Related Art

In present communication based train control systems, the train (e.g., a commuter train) determines its location and transmits it to the wayside for the wayside and other trains to work with. It is up to the train to take information about its surroundings and determine how to move safely, and correctly line up at platforms to exchange passengers. To do these vital functions, the train has to be able to vitally know its location and the area it takes up both static and dynamically.

During initialization of a communication based train control (CBTC) system, the train determines its location and the characteristics of the train consist. For a train that is capable of having variable train lengths, it is necessary that it determine its train length vitally. It is also necessary for each car in the train, that is capable of controlling the train, to vitally know where in the train consist it is located. This can be accomplished with different methods. Heretofore, these methods incorporated an independent train-borne means for determining train length, the characteristics of the consist as checked against an independent wayside based method to achieve vitality.

It would be desirable to provide multiple train-borne means and/or methods for determining train length and other characteristics of the trainconsist that avoid the need to use a wayside based method while maintaining vitality of such a system.

SUMMARY OF THE INVENTION

In one embodiment, a system for determining number of cars within a train consist includes one or more cars, at least one automatic train controller (ATC) for the one or more cars, and a train line spanning the train consist. Each car may include a frequency generator and a frequency modifier. Each frequency modifier in each of the one or more cars is adapted to receive an input signal at an input frequency and generate an output signal at an output frequency different from the input frequency. At least one frequency generator in at least one of the one or more cars provides a predetermined input signal at a predetermined input frequency to the frequency modifier in the at least one car when the at least one car is designated as a lead car and at least one frequency modifier in at least one of the one or more cars provides its output signal to the train line. The frequency modifiers in each of the one or more cars may be connected in series. In each of the frequency modifiers, a ratio of the input signal to the output signal may be two. The ratio of the input signal and the output signal may also be predetermined. The ATC may determine the number of cars in the train consist by comparing the output signal to the train line with the predetermined input signal from the frequency generator. The system may include a check system to determine if the at least one car is an end car. The frequency modifier that provides the output signal to the train line may be the end car. The system may also include a network node including a unique node network address in each of the one or more train cars in the train consist. The ATC may also determine the number of train cars in the train consist based on at least one of the unique network address and by comparing the output signal to the train line with the predetermined input signal from the frequency generator. The ATC may allow the train consist to move along a predetermined path based on the determination of the number of cars in the train consist determined from at least one of the unique network address and based on the ratio of the output signal to the train line and the predetermined input signal from the frequency generator.

Further disclosed is an embodiment of another system for of determining the number of train cars in a train consist and a position of each car in the train consist. The system includes a plurality of series connected frequency modifiers, with each car in the consist including one frequency modifier; a frequency generator supplying an electrical signal at a reference frequency to a first frequency modifier in the series of frequency modifiers; in response to the signal at the reference frequency, each frequency modifier in the series of frequency modifiers outputting a signal having a unique frequency that is based on the reference frequency and the number of frequency modifiers connected in series between said output signal and the frequency generator; and a controller determining from the frequency of the signal output by the last frequency modifier in the series of frequency modifiers, the number of cars in the consist.

Each frequency modifier in the series of frequency modifiers after the first frequency modifier and before the last frequency modifier: can receive as its input the signal output by an immediately preceding frequency modifier in the series of frequency modifiers; and can output its signal to the next frequency modifier in the series of frequency modifiers.

The signal output by each frequency modifier can have a frequency that is one-half or 50% of the frequency of the signal that was input into said frequency modifier.

The system can include a communication network. Each car of the consist can comprises a unique node of the communication network that has a unique network address. The controller can compare the number of cars determined from the frequency of the signal output by the last frequency modifier in the series of frequency modifiers to the number of unique nodes of the communication network and, based on the comparison, either enables the consist to remain stationary or to move.

The system can include a plurality of automatic train controllers (ATC), with each ATC disposed on one of the cars of the trains consist. Responsive to each ATC detecting a reference point disposed along a path that the consist traverses, said ATC can dispatch to the controller an indication that said ATC detected said reference point. Responsive to the dispatched indications that each ATC detected said reference point, the number of cars determined to be in the train consist, and a virtual map of the physical path that the consist traverses, the controller can determine an absolute position of the consist on the physical path.

Lastly disclosed is a method of determining a number of train cars of a train consist and a position of each car in the consist comprising: (a) a frequency generator of a first car of a consist outputting an electrical signal at a first frequency; (b) in response to the signal at the first frequency, a first frequency modifier of the first car outputting a signal at a second frequency; (c) in response to the output of the signal at the second frequency, a controller determining the number of cars in the consist.

The method can further include, in response to the signal at the second frequency, a second frequency modifier of a second car outputting a signal at a third frequency, wherein step (c) can include the controller determining the number of cars in the consist in response to the output of the signal at the third frequency.

The method can further include, in response to the signal at the third frequency, a third frequency modifier of a third car outputting a signal at a fourth frequency, wherein step (c) can include the controller determining the number of cars in the consist in response to the output of the signal at the fourth frequency.

For each frequency modifier, the frequency of each output signal is one-half of the frequency of the signal input into said frequency modifier.

Lastly, a means disposed on at least one car can determine from the frequency of the signal into the frequency modifier of said car, the position of said car in the train consist.

BRIEF DESCRIPTION OF THE DRAWINGS

FIG. 7 is a table showing input and output frequencies of the cars of train consist of FIG. 6;

FIG. 8 is another table showing input and output frequencies of the cars of train consist of FIG. 6;

FIG. 9 is a table correlating output frequencies to a number of cars in a train consist; and FIG. 10 is a table correlating output frequencies to the position of cars in a train consist.

DETAILED DESCRIPTION OF THE INVENTION

Figure 1:
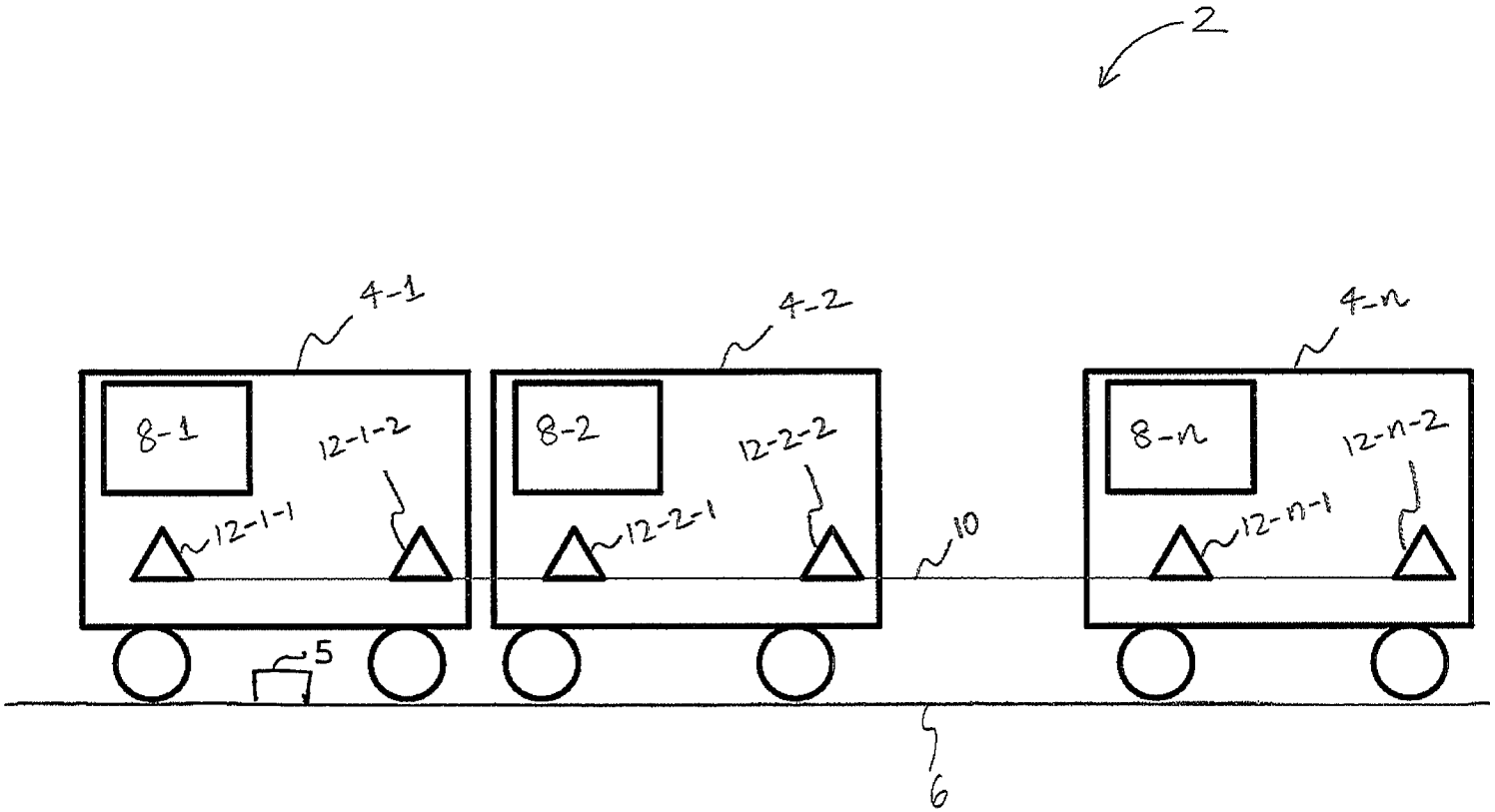
FIG. 1 is a diagrammatic view of a train consist including ATCs and an electronic communication network.

Disclosed is a train-borne method of determining a number of train cars in a train consist and train consist characteristics of each potentially controlling automatic train controller (ATC) equipped car in the train consist, wherein the train consist includes a plurality of series connected frequency modifiers, with each car including one frequency modifier and a train network. For the frequency portion of the method, it includes: (a) a frequency generator supplying an electrical signal at a reference frequency to a first frequency modifier in the series of frequency modifiers; (b) responsive to the signal input in step (a), each frequency modifier in the series of frequency modifiers outputting a signal having a unique frequency that is based on the reference frequency and the number of frequency modifiers connected in series between said output signal and the frequency generator; and (c) an ATC determining from the frequency of the signal output by the last frequency modifier in the series of frequency modifiers, the number of cars in the train consist.

A car in which a frequency generator will be active is determined at train startup and does not change. It may typically be in the end car that first keyed up without the frequency generator not already running to the first frequency modifier. At the other end of the train, during this setup, the final output frequency from the last frequency is sent back through the train for reading.

The ATC and the first frequency modifier can reside at the same car.

Each frequency modifier can output a signal at a frequency that is different than the frequency of the signal input into said frequency modifier. The signal output by each frequency modifier can have a frequency that is one-half or 50% of the frequency of the signal input into said frequency modifier.

Each frequency modifier between the first frequency modifier and the last frequency modifier in the series of frequency modifiers can receive, as its input signal, the signal output by an immediately preceding frequency modifier in the series of frequency modifiers and can output its signal to the next frequency modifier in the series of frequency modifiers.

A device or means can be disposed on at least one car for determining from the frequency of the signal input into the frequency modifier of said car, the position of said car in the train consist. The means for determining may either be the ATC of step (c) described above or another ATC.

The train consist can include a communication network. Each car of the train consist can comprise a unique node of the network that has a unique network address. The method can further include the step of (d) the ATC determining from the number of unique network address the number of cars in the train consist. The ATC can compare the number of cars determined in step (c) and the number of cars determined in step (d); and based on the comparison, the ATC can either cause the consist to remain stationary or allow the train consist to move.

The present invention will be described with reference to the accompanying Figures and where like reference numbers having different suffixes, e.g., −1, −2, etc., correspond to different instances of the same element.

Turning now to the drawings and referring to FIG. 1, a train consist 2 in accordance with the present invention includes one or more train cars 4 that are physically coupled together in series and otherwise connected and configured in a manner known in the art to travel along a path 6, e.g., train tracks or a guideway, under the control of a propulsion system disposed on one or more of said train cars 4 in a manner known in the art. In one non-limiting embodiment, the propulsion system derives its electrical power from an external source of electrical power, such as, without limitation, a third rail disposed along path 6 or an overhead electrical line (not shown) via a pantograph (not shown). The propulsion system includes an electric motor (not shown) that receives electrical power from the external source of electrical power via a propulsion control system (not shown) operating under the control of at least one ATC 8 that provides command and control signals to the propulsion control system to control the operation of the electric motor in a manner to cause consist 2 to travel along path 6 in an automatic or manually controlled manner. The foregoing description of the propulsion system and ATC 8 is provided for background only and is not to be construed as limiting the invention. The one or more ATCs 8 may be located anywhere on the train consist 2 and its position is not to be considered to be limiting.

Train consist 2 includes an electronic communication network 10 comprised of at least one node 12 in each car 4. Each node 12 is comprised of suitable network communications and control electronics that facilitate network 10 and establish the presence of each car 4 as a unique node of network 10 having a unique network address.

In consist 2, communication network 10 acts as a backbone for communication of the status of certain functions or operations of cars 4 to the ATC 8. These functions or operations may include, for example, without limitation, door(s) status (open or closed), where consist 2 is a commuter train; light(s) status; and the like. Communication network 10 is akin to a conventional computer network, such as a local area network that is utilized to communicatively connect a number of computers. In consist 2 shown in FIG. 1, network 10 communicatively connects the nodes 12 of cars 2. To facilitate communications across network 10, each node 12 has a unique network address in network 10 that is assigned to the node 12, either manually or automatically, at a suitable time, e.g., without limitation, during initialization of network 10.

Desirably, the network topology enables the ATC 8 to determine the physical order and/or the position of cars 4 in consist 2. For example, without limitation, node 12-1-1 and node 12-1-2 are assigned a first and a second network address that, among other things, indicates that car 4-1 is the first car in the consist 2; node 12-2-1 and node 12-2-2 are assigned a third and a fourth network address that, among other things, indicates that car 4-2 is the second car in the consist 2; nodes 12-3-1 and 12-3-2 (not shown) are assigned a fifth and a sixth network address that, among other things, indicates that car 4-3 (not shown) is the third car in the consist 2; and so forth. Thus the communication network 10 is able to develop the topology of the total train consist 2 composed of the cars in the train 4.

Figure 2:
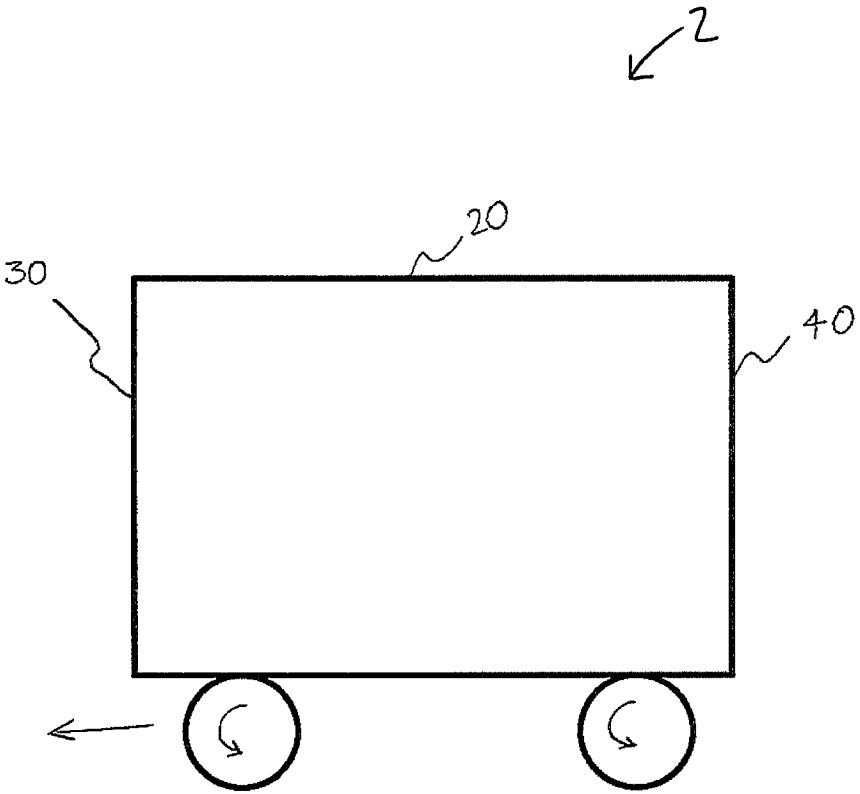
FIG. 2 is a diagrammatic view of a train consist including one car.
Figure 3:
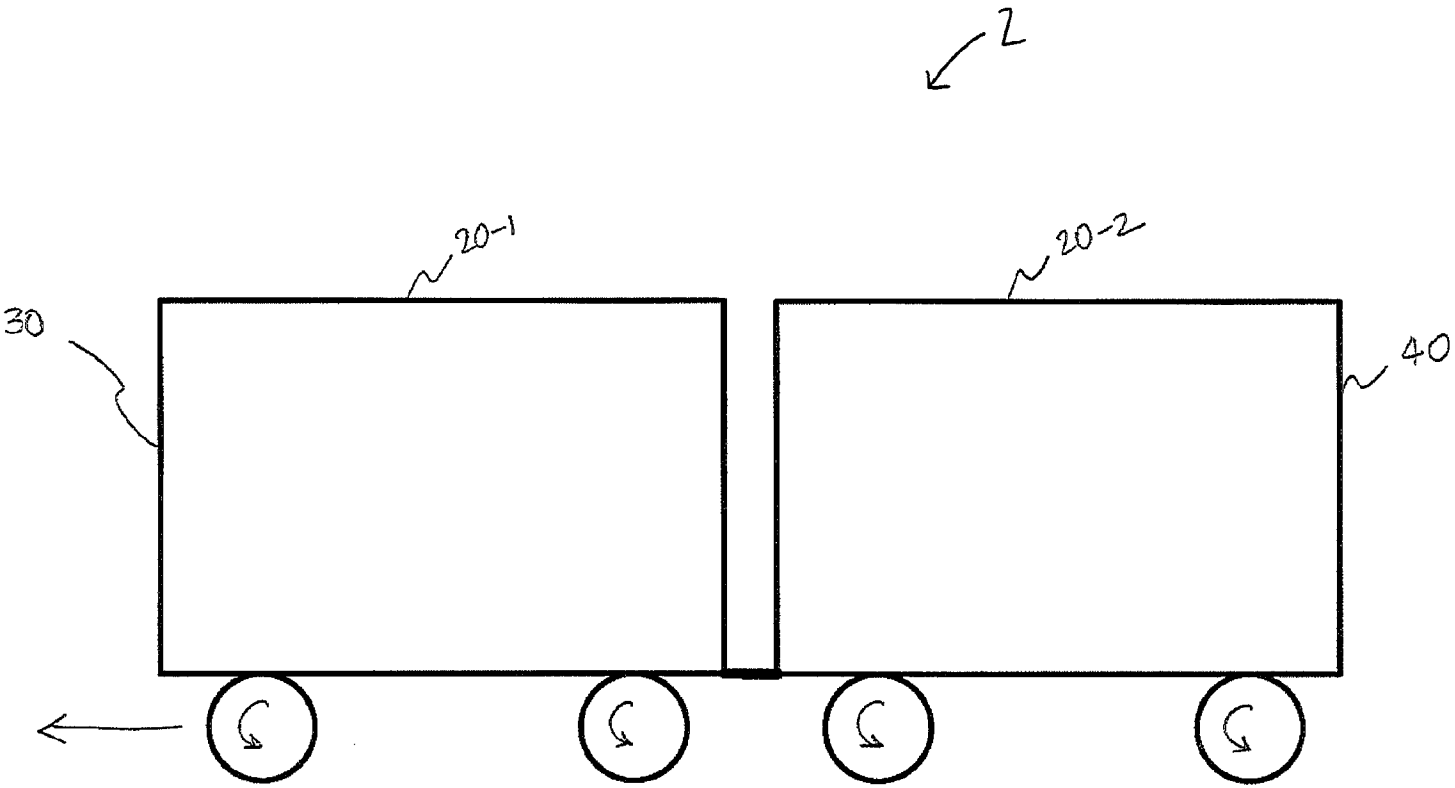
FIG. 3 is a diagrammatic view of a train consist including two cars.
Figure 4:
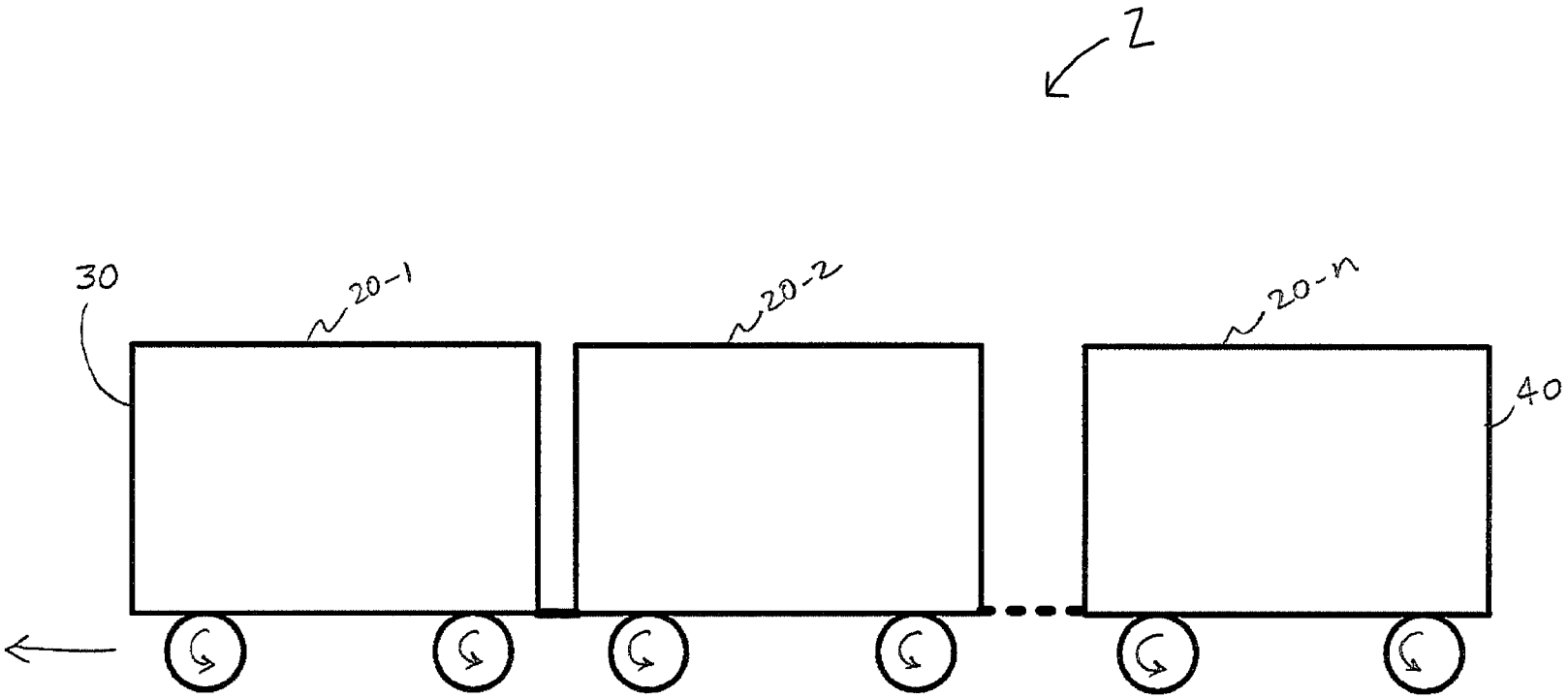
FIG. 4 is a diagrammatic view of a train consist including n number of cars.

Each car may also be designated to have, in certain circumstances, a leading end and a trailing end. In a single car consist, as shown in FIG. 2, the car 20 may have both a leading end 30 and a trailing end 40. In a two-car consist, as shown in FIG. 3, either of the two cars 20-1, 20-2 may include leading end 30 or trailing end 40, but not both. In general, regardless of the number of cars in a n-car train consist, as shown in FIG. 4, having cars 20-1, 20-2 . . . **20-*n* will have only one leading end 30 (in car 1) and only one trailing end 40 (in car n). In an alternate embodiment (not shown), the leading end 30 may be designated on car 20-*n*, while the trailing end may be designated on car 20-1**.

In the present embodiment, the leading end 30 in a train consist is designated as the end of a car 20 that is first keyed up. This is achieved by a manual key up operation, or by any other means known to one skilled in the art. Typically, the leading end 30 is designated as that end that is pointing towards the direction of intended travel of the train consist 2. While, for the purposes of providing clarity, we will maintain this general rule of thumb, it should be noted that for the purposes of determining train length, it is possible to have either of the ends of the train consist to be designated as the leading end 30, with the opposite end of the train consist being designated as the trailing end 40. Moreover, once a lead car 20 has been designated for a train consist, it does not typically change until the consist is powered down or broken.

Figure 5:
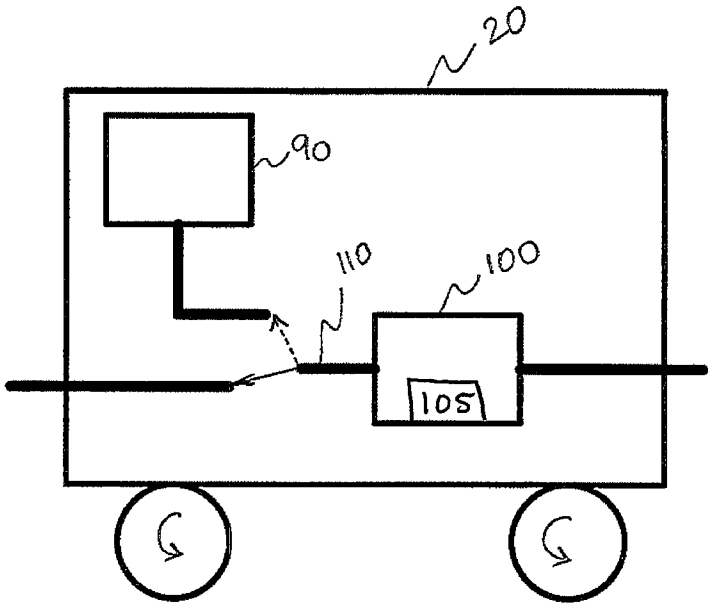
FIG. 5 is a diagrammatic view of a train car including means for determining the number of train cars in the train consist and the position of each train car in the train consist.

In accordance with one aspect of the present technique, as shown in FIG. 5, while remembering that any car 20 in a train consist 2 may be used as a lead car (a car having a leading end) or a trailing end car (a car having a trailing end), each car 20 in a train consist may include a frequency generator 90, and a frequency modifier 100. The frequency modifier 100 in the car is adapted to receive an input signal 110 from either the frequency generator 90 (when the car is designated as a lead car) or from a signal output from a frequency modifier 100 in a car (not shown) if there is a car in front. However, the frequency modifier 100 is not adapted to receive a signal from both.

Figure 6:
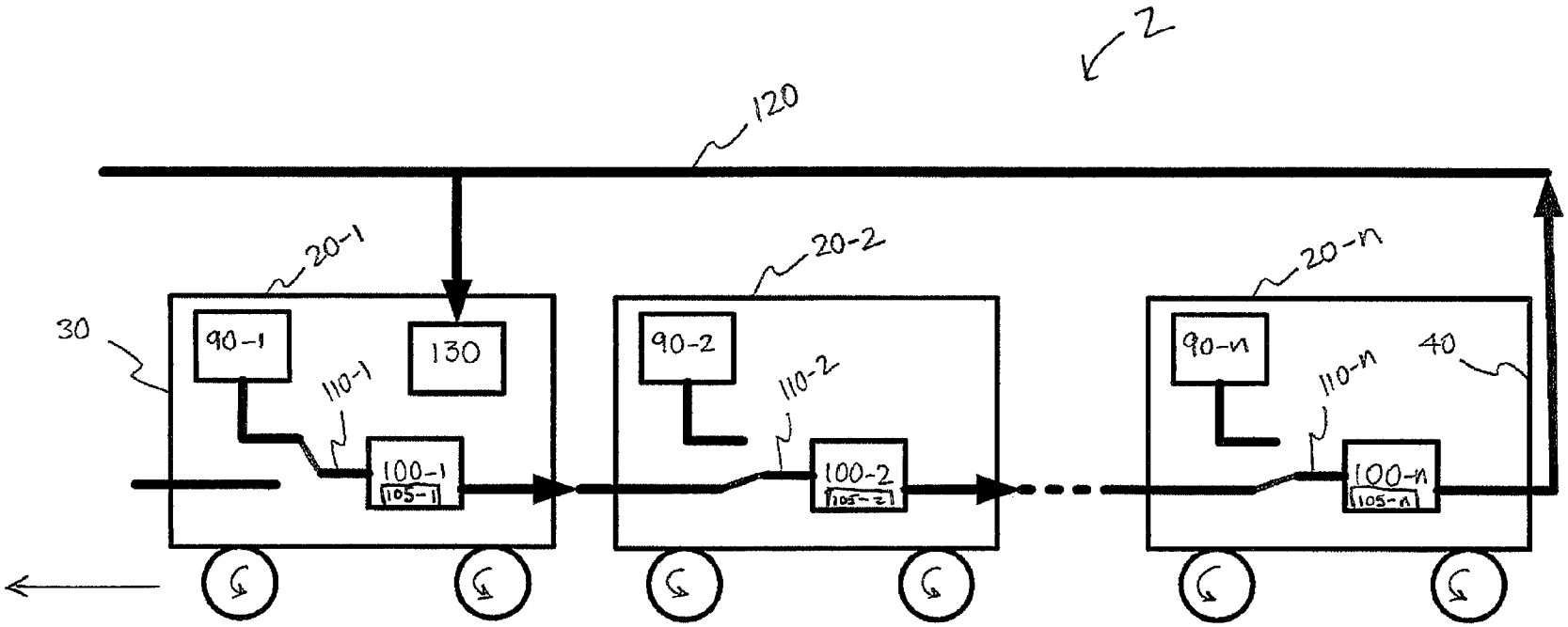
FIG. 6 is a diagrammatic view of a train consist including n number of cars in series and means for determining the number of train cars in the train consist and the position of each train car in the train consist.

In accordance with another aspect of the present technique, as shown in FIG. 6 an n-car consist may comprise cars 204, 20-2 . . . **20-*n* connected in series, with the lead car being designated as car 20-1 and the trailing car being designated as the car 20-*n*. With frequency modifier 100-1 in the lead car, and frequency modifier 100-*n* in the trailing car, it can be described that the frequency modifier 100-1 receives its signal input 110-1 from the frequency generator 90-1 in car 20-1, while the frequency modifiers in every other car receives its input from the frequency modifier 100 in the car in front of it. In other words, input to frequency modifier 100-2 is the output of the frequency modifier 100-1** and so on.

The output of the frequency modifier **100-*n*, since it is in the trailing car (having a trailing end), is fed into the frequency output train line 120. While the train line 120 is illustrated as being outside the train consist for the sake of clarity, it is very much a part of the train consist. The frequency output train line 120 is read by an active ATC 130. It should also be noted that the frequency generators 90-2, 90-3 . . . 90-*n* may remain inactive or may be unable to provide any output. In other words, for every train consist 2 in operation, only one frequency generator 90 may be functioning, e.g., frequency modifier 90-1 in FIG. 6. It is noted that because only one frequency generator will be operational, it is not necessary that every car 20** include a frequency generator.

For systems running on CRTC technology, it is typical for the train consist to include more than one ATC 130 for the purposes of redundancy. For example, if there are two ATCs 130 in a train consist 2, both the ATCs 130 would be listening all the time. However, only one ATC 130 would be active i.e., making the decisions. The second ATC 130 that is only listening will become active in the instance of a failure of the presently active ATC 130. In one embodiment, the train consist 2 including more than one car may include an ATC 130 in each car of the train consist 2. In another embodiment, the train consist 2 including more than two cars may include an ATC 130 in every alternate car. To this end, in a train consist including 10 cars, there may only be two ATCs 130 present anywhere in the train consist. The position of the ATC 130 in relation to the cars in the train consist is not to be considered as limiting since the ATC 130 is capable of performing its function regardless of whether the two ATCs 130 are present side by side or in opposite ends of the train consist. It is, however, a preference that there be a minimum of two ATCs 130 within a train consist for operational stability.

It must be realized that all the frequency modifiers 100-1, 100-2 . . . **100-*n* may include a check system 105, as shown in FIGS. 5-6. Check system 105 may be a resident logic component that checks if the car it is disposed on is a trailing car or not. In one embodiment, the check system 105 may determine based on coupler configuration, or a sealed doorway, or by selection of a switch position that identifies the car as being a trailing car. Any known methods of designating a car as being a trailing car or an end car may be used by the check system 105 and the choice of any particular system should not be considered as limiting. When the check system 105-*n* of FIG. 6 determines that a car is the trailing car, which in this case is car 20-*n*, the frequency modifier 100-*n* will feed its output to the active ATC 130 via the frequency output train line 120. If the check system 105 determines that the car is not a trailing car, the output of each frequency modifier 100 is provided as an input to a subsequent frequency modifier 100. As illustrated, check system 105 is located within frequency modifier 100. However, it is also possible in other embodiments for the check system 105 in some or all of the cars to be housed outside of the frequency modifier. The disposition of the check system 105** should not be considered as limiting.

In the embodiment of consist 2 shown in FIG. 1 that includes cars 4-1-4-N, car 4-1 includes frequency generator 16 and frequency modifier 18-1. The frequency generator is determined at train startup and does not change. It may typically be in the end car that first keyed up without the frequency generator not already running to the first frequency modifier. At the other end during this setup the final output frequency from the last frequency is sent back through the train for reading.

Referring back to FIG. 6, the input signal 110-1 to frequency modifier 100-1 is from the frequency generator 90-1. The frequency generator 90-1 generates the signal 110 at a reference frequency that is pre-determined on a on a per-train basis, or on a per-system basis.

The signal output 110-1 by frequency generator 90-1 at the pre-determined frequency is thereafter sent to the frequency modifier 100-1 where it is modified to generate an output signal 110-2 which is provided as the input to the modifier 100-2 on car 20-2. The signal 110-2 is an electrical signal at a different and unique frequency compared with the predetermined frequency of the signal from the frequency generator 90-1. Similarly, the frequency modifier 100-2 modifies the signal 110-2 and generates a signal 110-3 at a third unique and different frequency and so on. The output frequency of each of the frequency modifiers 100-1, 100-2 . . . **100-*n*** is different, and unique such that there is no two frequency modifiers generating an output signal at the same frequency.

The output of frequency modifier **100-*n* (the last frequency modifier in the series of frequency modifiers) is supplied directly back to ATC 130** for processing in a manner to be described hereinafter.

The ATC 130 determines the number of cars in the train consist 2 by comparing the frequency of the signal output from the frequency modifier **100-*n* and the frequency of the signal output 110-1 from the frequency generator 90**.

In accordance with one embodiment, the series of frequency modifiers 100-1, 100-2 . . . **100-*n* are used to constantly divide the frequency of the incoming signal by a factor of two to generate an output signal having a frequency that is one-half of the frequency of the input signal, the ATC 130 uses the ratio of the input frequency to the frequency modifier 100 in the lead car and the output frequency from the frequency modifier 100** in the trailing car.

Consider an example of a 5-car consist including cars 20-1, 20-2 . . . 20-5 and where each of the frequency modifiers 100-1, 100-2 . . . 100-5 in series are used to divide the frequency of their input signal by a factor of two to generate the output signal. For the sake of clarity, FIG. 7 tabulates the input and output signal frequencies to and from each of the frequency modifiers in the train consist. It can be seen that the ratio of input frequency into car 20-1 by the output frequency from car 20-5 is 32. Since the ratio is greater than 1, and the logic chosen was a divide-by-two logic, the number of cars may be determined as a power of two. The resulting ratio of frequencies "32" can be expressed as an exponent of 2, as in $2^5$, the number of cars can be determined as 5.

In another embodiment, when the frequency modifiers 100-1, 100-2 . . . **100-*n* in a S-car consist, having cars 20-1, 20-2 . . . 20-5 are used in combination with a multiply-by-two logic, an exemplary tabulation of input and output frequencies may be as shown in FIG. 8**. In this embodiment, the ratio of frequencies between the input frequency from the frequency generator and the output signal frequency from the frequency modifier in the trailing car is 128/4096 or simply, 1/32. Since this ratio is less than 1, the determination of cars may be made as follows:

Number of cars, n can be determined as follows: $1/2^n=1/32=1/2^5$

Leading to the determination that n=5.

By using the combination of the frequency modifier arrangement described above, with the determination of number of cars using the unique network address from a network node in each car, it is possible for the ATC to vitally determine the number of cars in a train consist without the need for any wayside component.

In the following sections, non-limiting descriptions of using the frequency generators and frequency modifiers for determining the order and/or the position of each car are provided.

Referring back to FIG. 6, at a suitable time, ATC 130 causes frequency generator 90-1 to output a signal at a first reference frequency. In this example, the first reference and predetermined frequency is 8192 Hz. However, this frequency is not to be construed as limiting the invention since it is envisioned that any suitable reference frequency could be used. The first reference frequency output by frequency generator 90-1 is supplied as an input to frequency modifier 100-1. Frequency modifier 100-1 generates an output signal 110-2 using its input 110-1, the output signal 110-2 having a second, different frequency. In one desirable embodiment, frequency modifier 100-1 is a divide-by-two type of modifier and therefore outputs a signal 110-2 having a frequency that is one-half or 50% of the frequency of the signal input 110-1 into frequency modifier 100-1. In the present non-limiting example, the signal input into frequency modifier 100-1 has a frequency of 8192 Hz and the signal output by frequency modifier 100-1 has a frequency of 4096 Hz. It should be noted that all of the frequency modifiers 100-1, 100-2 . . . **100-*n* will be of similar type and function. In other words, if one frequency modifier 100-1 is a divide-by-two type, all of the frequency modifiers 100-2, 100-3 . . . 100-*n* in the train consist will be divide-by-two type. In accordance with another aspect of the present embodiment, the frequency modifier 100-1, 100-2 . . . 100-*n*** may be configured to increase the input signal frequency by a predetermined amount, such as multiply-by-two by way of an example.

In accordance with an embodiment of the arrangement as shown in FIG. 6, where the total number of cars in the train consist is one, the output of frequency modifier 100-1 is returned directly to ATC 130 which has access to an electronic version of a table as illustrated in FIG. 9. ATC 130 includes suitable means for determining the frequency of the signal output by frequency modifier 100-1, in this example 4096 Hz. Armed with the knowledge of the frequency of the signal output by frequency modifier 100-1, ATC 130 can match this frequency against the table illustrated in FIG. 9 and determine that the train consist 2 includes only one car 20, in this example, car 20-1.

In accordance with another embodiment of the arrangement, as shown in FIG. 6, where the total number of cars in the train consist 2 is two, i.e., 20-1 and 20-2, the output 110-2 of frequency modifier 100-1 is supplied to the input signal 110-2 of frequency modifier 100-2, which modifies or changes the frequency of this input signal 110-2 and outputs a signal 110-3 at a third, different frequency. In this exemplary embodiment, the signal output 110-3 by frequency modifier 100-2 has a frequency that is one-half or 50% of the frequency of the signal input into frequency modifier 100-2. In this non-limiting example, the signal input into frequency modifier 100-2 has a frequency of 4096 Hz. Since frequency modifier 100-2 will reduce this frequency by one-half or 50%, the signal output 110-3 from frequency modifier 100-2 will have a frequency of 2048 Hz. Since in this embodiment, there are only two cars, 20-1 and 20-2, the output signal 110-3 from frequency modifier 100-2 will now be returned via the output frequency train line 120 to the ATC 130, which by comparing the frequency of the output signal 110-3 against the table as depicted in FIG. 9, will determine that the train consist 2 comprises a total of two cars.

Desirably, ATC 130 further compares the number of train cars determined from the arrangement of frequency modifiers 100 and their output signals 110 to the number of train cars 20 determined by the ATC 130 from the number of unique network addresses of network 10. If the number of cars 20 of the train consist determined by both methods match, ATC 130 can enable the propulsion system to move the train consist along the path 6. On the other hand, if the number of cars 4 determined by both methods do not match, ATC 130 can have the propulsion system keep consist 2 stationary, e.g., by causing the propulsion control system to withhold electrical power from the electric motor used to propel consist 2. Thus, achieving a method of vitally determining train length of a train consist 2 from on-board the train consist 2.

In accordance with another aspect of the invention and referring to FIG. 6, the ATC 130 in each car in the train consist 2 may determine its position in the train consist 2 with reference to an electronic version of a table as illustrated in FIG. 10 and the frequency of the signal supplied to the input of the frequency modifier 100 of said car 20. For example, if the frequency of the signal input into frequency modifier 100-1 by frequency generator 90-1 is 8192 Hz, this signal and its frequency can be fed to ATC 130 where the frequency of this signal is determined. The ATC 130 uses this thus determined frequency, in this case 8192 Hz, and extracts from table as shown in FIG. 10, a number from the row entitled "Position in consist" in the same column as said frequency, which number corresponds to the position of the car 20-1 that includes frequency modifier 100-1 in consist 2. In this example, ATC 130 would extract the number "1" from the table in FIG. 10 corresponding to 8192 Hz.

In a similar manner, each ATC 130 included in a car 20 can automatically determine the position of its car 20 in the train consist 2 by comparing the frequency of the signal input into the frequency modifier 100 of said car 20 to the frequencies as shown in FIG. 10 and extracting from the tabulation as shown in FIG. 10 the "Position in consist" number that corresponds to the frequency of the signal input into said frequency modifier.

Also or alternatively, each car 20 that includes an ATC 130 can determine its position in the train consist 2 with reference to the tabulation as shown in FIG. 9 and the frequency of the signal output 110 by the frequency modifier 100 of said car 20. For example, if the frequency of the signal output 110-2 by frequency modifier 100-1 is 4096 Hz, ATC 130 can use this frequency and the tabulation of FIG. 9 to extract the number "1" from the tabulation corresponding to 4096 Hz. This number "1" tells ATC 130 that train consist 2 has one car 20.

In a similar manner, the ATC 130 included anywhere in the train consist 2 can automatically determine the position of any of its cars 20 in the train consist 2 by comparing the frequency of the signal output 110 by the frequency modifier 100 of each of the car 20 to the frequencies as shown in the tabulation of FIG. 9, and extracting the value in the column "Position in consist" that corresponds to the frequency of the signal input 110 into said frequency modifier 100.

Returning back to FIG. 1, desirably, the communication network 10 knows the position of each node 12 (such as 12-1-1, 12-1-2, 12-2-1, etc). For example, where consist 2 includes multiple nodes 12, network 10 can know that nodes 12-1-1/12-1-2 are in car 4-1, that nodes 12-2-1/12-2-2 are in car 4-2 which is coupled to car 4-1, that nodes 12-3-1/12-3-2 (not shown) is in car 4-3 (not shown) which is coupled to car 4-2, and so forth through car 4-N being coupled to car 4-(N–1). Desirably, each ATC 8 is either supplied with or has access to a network map of network 10 that includes the order of the unique network addresses of communication network 10, which order corresponds to the position of each car 4 in consist 2. Armed with this information, each ATC 8 can compare the position of its car 4 from the network address data to the position of its car determined from the frequency of the signal input 110 into or output from frequency modifier of said car 4. It is noted that ATC 8 in FIG. 1 and ATC 130 in FIG. 6 refer to like components.

Each car 4 that includes an ATC 8 can determine its orientation in the consist by noting the actual direction its car's wheels are turning with respect to the total train moving in a train-forward direction. The wheels in the car may turn in a forward direction or a reverse direction depending on how the car is oriented in the train consist 2. Cars in a train may always have one particular end of each car facing the front of the train. It is possible though that the cars may be set into the train consist in a random fashion such that one particular end of each car may not always be facing the front of the train. Some may have the one particular end of each car facing the front of the train while others face the rear of the train. This will cause the directions each car's wheels turn, forward or reverse, to be a factor of how each car is oriented within the train consist 2.

The train network can determine orientation of each car in the consist from consist topology developed from connectivity of nodes within the train consist in the train network. This does not require the train to actually move to do so.

Only an ATC equipped car can combine orientation in consist as determined by itself with orientation in consist from train network topology. This combination of information from two independent sources can be compared by the ATC to vitally determine orientation in consist for itself.

Each car 4 that includes an ATC 8 can determine its relationship in the train to the absolute position within the system. Only an ATC equipped car can determine its relationship of itself in the train consist to absolute position within the system. That car can drive over a reference point 5, and preferably two or more reference points 5, as shown in FIG. 1 to determine its relationship of itself in the train consist to absolute position within the system. Each reference point 5 has a unique identity with respect to all other reference points in the system. After the ATC 8 equipped car drives over reference points 5, it knows where it is in the system and what its direction of travel is.

In one desirable embodiment, a frequency modifier within each car is implemented as a divide-by-2 counter which is implemented by a flip-flop circuit which is configured and operative for dividing the frequency of a signal input into said flip-flop by 2 and outputting a signal having a frequency that is one-half or 50% of the frequency of the input signal. However, this is not to be construed as limiting the invention as it is envisioned that each frequency modifier can be implemented in any suitable and/or desirable manner known in the art. For each frequency modifier implemented by a divide-by-2 counter, a test circuit (not shown) can be provided to test said divide-by-2 counter's capacity to divide an input frequency by 2. Each such test circuit can be coupled to an ATC in any suitable manner, whereupon the ATC can exercise independent control of said test circuit to test the corresponding divide-by-2 counter in any suitable or desirable manner that confirms the ability of said divide-by-2 counter to divide the frequency of an input signal by 2.

In summation, it can be seen how the frequency modifier and a train network can be used to determine train length, and position in train consist. Taking this information and further input from train devices its orientation in the train consist and its relationship in the train to the absolute position within the system can be determined. All of the above go into determining train location and the characteristics of the train consist.

The present invention has been described with reference to exemplary non-limiting embodiments. However, such exemplary embodiment is not to be construed as limiting the invention inasmuch as obvious modifications and alterations will occur to others upon reading and understanding the preceding description. For example, the functions described above for ATC can be implemented by any suitable combination of electronic/electrical hardware, and/or standalone or networked programmed computers/microprocessors acting independently or together, and the like. It is, therefore, intended that the invention be construed as including all such modifications and alterations insofar as they come within the scope of the appended claims or the equivalents thereof.

The invention claimed is:

1. A system for determining number of cars within a train consist, comprising:

one or more cars, each car comprising:

a frequency generator; and a frequency modifier;

at least one ATC (Automatic Train Controller) for the one or more cars;

a train line spanning the one or more cars; and a communication network comprising a unique node network address in each of the one or more cars, wherein:

each frequency modifier in each of the one or more cars is adapted to receive an input signal at an input frequency and generate an output signal at an output frequency different from the input frequency;

the frequency generator in one car provides a predetermined input signal at a predetermined input frequency to the frequency modifier in said one car when said one car is designated as a lead car and the frequency generator of each other car is inactive or is unable to provide an output to the frequency modifier of said car;

at least one frequency modifier in at least one of the one or more cars provides its output signal to the train line; and in response to a match or mismatch between the number of cars in the train consist determined by the ATC from (1) the unique node network addresses and (2) a ratio of the output signal to the train line and the predetermined input signal from the frequency generator, the ATC respectively enables or disables movement of the train consist along a path.

2. The system of claim 1, wherein the frequency modifiers in each of the one or more cars are connected in series.

3. The system of claim 2, wherein in each of the frequency modifiers, a ratio of the input signal to the output signal is two.

4. The system of claim 3, wherein the ratio of the input signal and the output signal is predetermined.

5. The system of claim 1, wherein at least one car comprises a check system to determine if the at least one car is an end car.

6. The system of claim 5, wherein the frequency modifier in the end car provides its output signal to the train line.

7. A method of determining a number of train cars in a train consist comprising a plurality of cars connected in series and including a plurality of frequency modifiers, one per car, connected in series and a frequency generator in each car, and a communication network comprising a unique network address in each car, the method comprising the steps of:

providing a predetermined, first input signal from the frequency generator in a first car to an input of a first frequency modifier in the first car;

the first frequency modifier generating a first output signal at an output frequency different from the input frequency of the first input signal;

providing the first output signal from the first frequency modifier to an input of a second frequency modifier in a second car that has its frequency generator inactive or unable to provide an output to a frequency modifier;

the second frequency modifier generating a second output signal at an output frequency different from the input frequency of the first output signal;

determining the number of train cars in the train consist based on: (1) the first input signal and an output signal generated by the second or subsequent frequency modifier in the series and (2) the unique network addresses; and in response to a match or mismatch between the number of cars in the train consist determined from (1) the first input signal and the output signal generated by the second or subsequent frequency modifier in the series and (2) the unique network addresses, enabling or disabling movement of the train consist along a path.

8. The method of claim 7, further comprising providing the output signal from each frequency modifier to a subsequent frequency modifier in a subsequent car if an end car condition is not determined for a last of the series of connected cars.

9. The method of claim 7, comprising determining the number of train cars in the train consist by comparing the frequency of the output signal output by the last frequency modifier in the series of frequency modifiers against a lookup table comprising a predetermined list of frequencies and number of cars.

10. The method of claim 7, comprising reducing the frequency of output signals between any two frequency modifiers by 50%.

11. The method of claim 7, comprising increasing the frequency of output signals between any two consecutive frequency modifiers by 50%.

12. The method of claim 7, comprising determining the unique network address for a unique node in each car.

* * * * *